US007080760B2

(12) United States Patent
Yu

(10) Patent No.: US 7,080,760 B2
(45) Date of Patent: Jul. 25, 2006

(54) LEAKPROOF PERFUME SPRAY HEAD

(75) Inventor: Yuan-Wen Yu, Taoyuan Hsien (TW)

(73) Assignee: Ing Wen Precision Ent. Co., Ltd., Taoyuan Hsien (TW)

( * ) Notice: Subject to any disclaimer, the term of this patent is extended or adjusted under 35 U.S.C. 154(b) by 10 days.

(21) Appl. No.: 11/023,376

(22) Filed: Dec. 29, 2004

(65) Prior Publication Data

US 2006/0138172 A1 Jun. 29, 2006

(51) Int. Cl.
*B05B 11/06* (2006.01)

(52) U.S. Cl. ..... 222/633; 222/209; 222/153.12; 222/153.14; 239/318; 239/434

(58) Field of Classification Search ..... 222/401–402, 222/394, 400.8, 630–633, 153.04, 153.02, 222/153.14, 153.11, 153.12, 209, 261; 239/431, 239/433, 434, 318; 137/205, 209
See application file for complete search history.

(56) References Cited

U.S. PATENT DOCUMENTS 2,622,770 A * 12/1952 Penno ..... 222/464.1
2,755,132 A * 7/1956 Croce ..... 239/353
3,632,046 A * 1/1972 Hengesbach ..... 239/318
3,770,209 A * 11/1973 Wilcox ..... 239/434
4,123,005 A * 10/1978 Blunk ..... 239/327
4,383,622 A * 5/1983 Guth ..... 222/209
5,529,244 A * 6/1996 Horvath, et al. ..... 239/318
5,738,254 A * 4/1998 de la Guardia ..... 222/400.8
6,042,026 A * 3/2000 Buehler, II ..... 239/346
6,094,778 A * 8/2000 Boukas ..... 15/409
6,991,136 B1 * 1/2006 de la Guardia ..... 222/209

* cited by examiner

*Primary Examiner*—Frederick C. Nicolas
(74) *Attorney, Agent, or Firm*—Troxell Law Office, PLLC

(57) ABSTRACT

A leakproof perfume spray head comprises a spray head, a locking shell, an inner sleeve, a rotation shaft, and an outer cover, wherein the locking shell is locked to a perfume bottle and a sleeving section on a lower end of the inner sleeve is inserted into the locking shell. An orientation ring is jammed in the shallow trench that forms on the top of the inner sleeve, wherein the center of the shallow trench communicates with a first through hole. A threaded section is formed on the inner surface of the first through hole. The rotation shaft includes a second through hole and protrudent circular teeth. The protrudent threads are engaged with the threaded section, wherein a gap is formed between the inner sleeve and the first through hole. The protrudent threads of the rotation shaft are locked to the threaded section of the inner sleeve.

2 Claims, 8 Drawing Sheets

LEAKPROOF PERFUME SPRAY HEAD

BACKGROUND OF THE INVENTION

1. Field of the Invention

The present invention relates to a leakproof perfume spray head, and more particularly to the improved structure of the perfume spray head that includes a locking structure to effectively improve the problem of the perfume bottle, which suffers from leakage easily during its transportation process and when it is heated.

2. Description of the Related Art

The common form of the general commercial perfume product primarily refers to the bi-horizontal spray series. In view of the existing quality request and the existing refined and novel industrial requirements of the perfume bottle, the cooperated spray head, which has bad design, will significantly limit its application. If the conventional perfume bottle is filled with perfume liquid, the leakage problem of the perfume liquid, which is caused by pressure and high temperature after the long-distance transportation, leads this perfume bottle to become a defective object.

As shown in FIG. 8, the conventional perfume spray bottle provides a spray head 10 having a horizontal receiving hole 101 and a tunnel 104 connected to the horizontal receiving hole 101, wherein a liquid supply pipe 20 is assembled underneath the tunnel 104 and a spray-creating device 102 is disposed inside the horizontal receiving hole 101. Moreover, a gas supply pipe 103 is connected to the rear end of the spray-creating device 102. In the aforementioned structure, the perfume liquid is transported to the tunnel 104 through the liquid supply pipe 20 directly since the spray head 10 is directly connected and secured to the perfume bottle such that the perfume liquid is able to spread to the horizontal receiving hole 101. The perfume bottle suffers from the problem of perfume leakage after it experiences the long-distance transportation and the high temperature environment.

In order to improve this problem, the manufactures do not assemble the spray head and the perfume bottle before they are sold. They are assembled together by the consumer after the consumer buys them. This kind of separate type assemblage method is the existing best way conceived by the manufactures to prevent the perfume liquid from overflow and leakage.

SUMMARY OF THE INVENTION

Because of pressure the conventional perfume bottle where the perfume liquid stored therein suffers from leakage easily during the transportation process. In view of this incurable problem, the present inventor provides a leakproof perfume spray head to overcome this long-term problem effectively.

The main object of the present invention is to provide a leakproof perfume spray head. When the spray head is assembled or not in use, the spray head can be rotated in small angle so as to close the inner tunnel of the spray head completely to prevent the perfume liquid from leakage. If it is in use, the spray head is reversely rotated in small angle to open the inner tunnel of the spray head.

The other features and preferred embodiments of the present invention will now be described with reference to the accompanying drawings.

DETAILED DESCRIPTION OF THE PREFERRED EMBODIMENT

Figure 1:
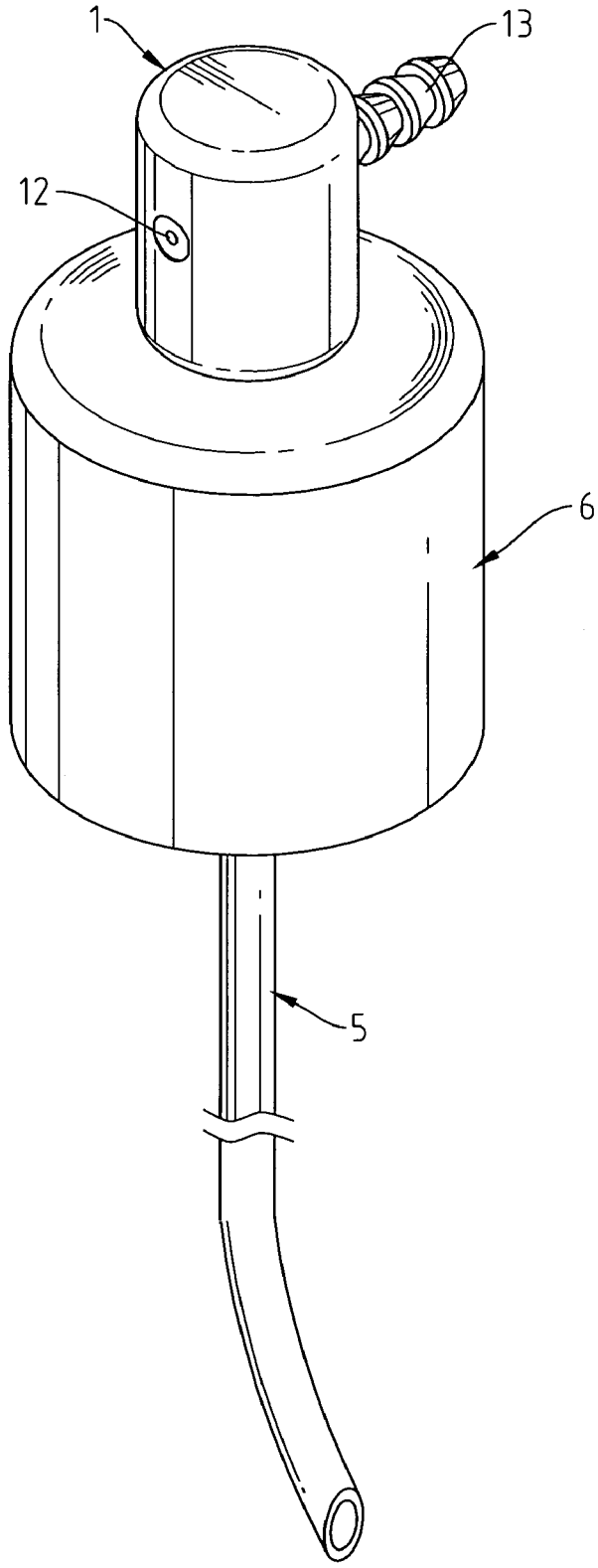
FIG. 1 is an elevational view showing the outward appearance of the present invention.
Figure 2:
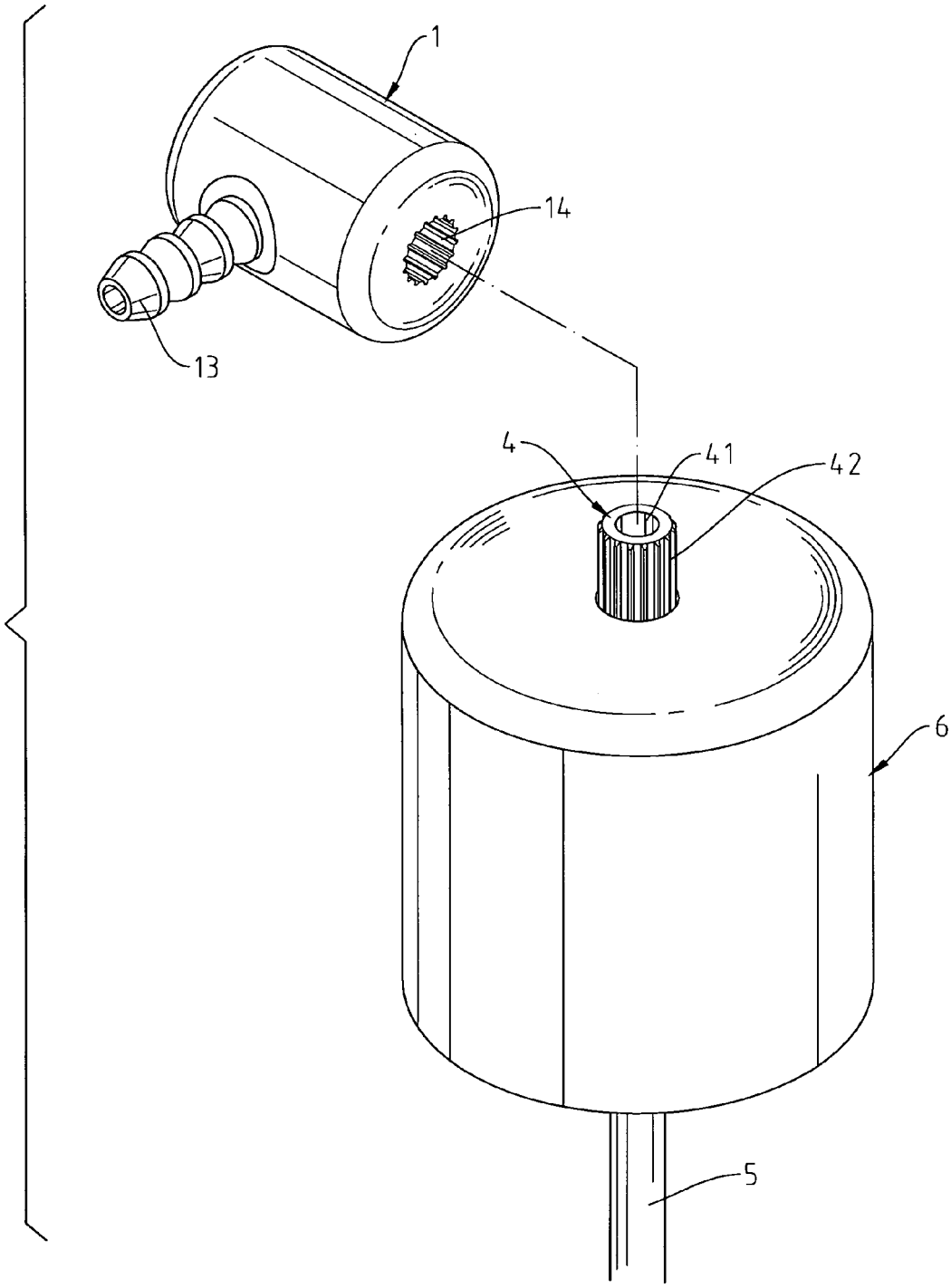
FIG. 2 is an elevational view showing the partial decomposed diagram of the present invention.
Figure 3:
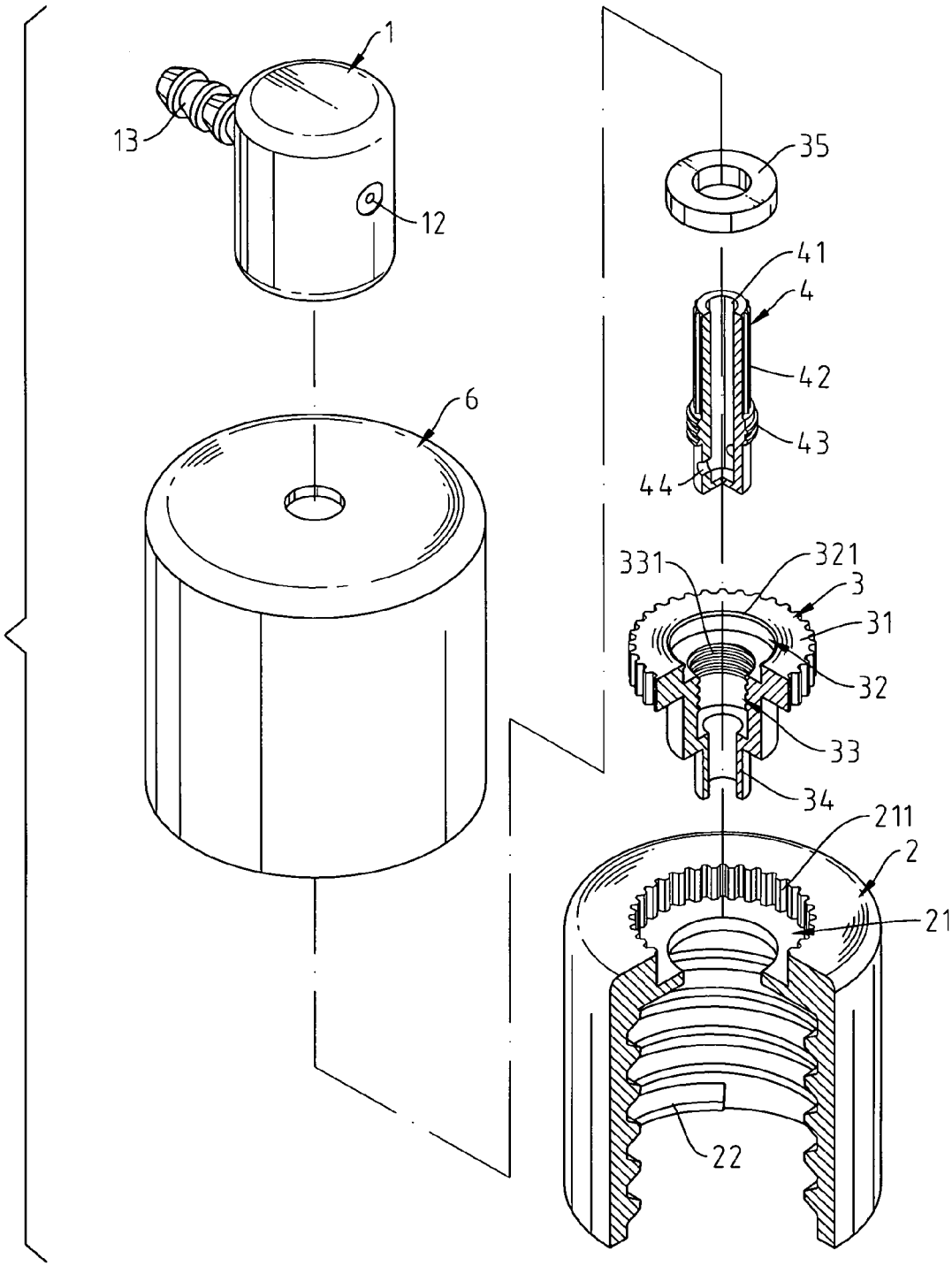
FIG. 3 is an elevational view showing the decomposed diagram of the present invention.
Figure 4:
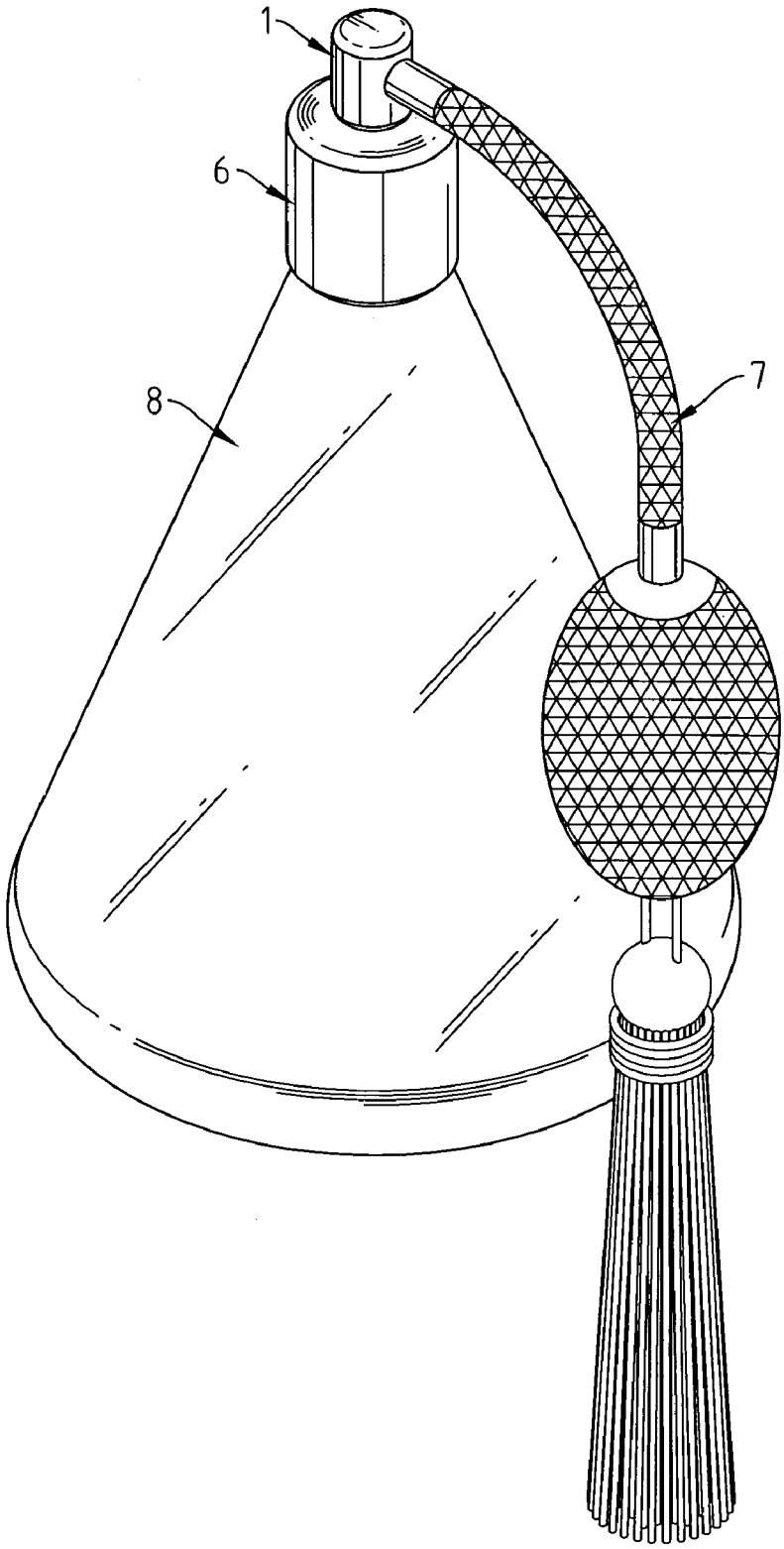
FIG. 4 is an elevational view, which shows that the present invention is assembled to a gas supply device.

The other objects and detailed structure of the present invention will become apparent from the following detailed description of the preferred embodiments with reference to the accompanying drawings.

As shown in FIG. 1 through FIG. 4 and FIG. 6, the leakproof perfume spray head of the present invention primarily comprises a spray head 1, a locking shell 2, an inner sleeve 3, a rotation shaft 4, and an outer cover 6, wherein the locking shell 2, the inner sleeve 3, and the rotation shaft 4 are assembled inside the outer cover 6, and the rotation shaft 4 is assembled and connected with the spray head 1.

The aforementioned spray head 1 includes a horizontal receiving hole 11 and an inner-toothed hole 14. One end of the horizontal receiving hole 11 is communicated with a spray nozzle 12 and the other end of the horizontal receiving hole 11 is coupled with a gas supply pipe 13 for connecting with a gas supply device 7 by use of its outer portion.

A screwing part 22 that mounts inside the locking shell 2 mounted inside the outer cover 6 is assembled and coupled with a perfume bottle 8. A circular trench 21 having an indented connection trench 211 on its inner surface is formed on the top of the locking shell 2. The circular trench 21 is designed for coupling with the inner sleeve 3.

The inner sleeve 3 includes a connection body 31 for engaging with the indented connection trench 211. A sleeving section 34 that forms on the lower end of the inner sleeve 3 is inserted into the locking shell 2. A shallow trench 32 is formed on the top of the inner sleeve 3, wherein the center of the shallow trench 32 is communicated with a through hole 33. A threaded section 331 is formed on the inner surface of the through hole 33. The diameter dimension of the through hole 33 is different from that of the sleeving section 34 so as to facilitate the connection with the rotation shaft 4 and the waterline 5 respectively.

The rotation shaft 4 includes a through hole 41 formed therein and protrudent circular teeth 42 mounted on the medium and lower portions of the outside of the rotation shaft 4. These protrudent circular teeth 42 separate protrudent threads 43 and a radial through hole 44 that mount on the upper portion and the lower portion of the rotation shaft 4 respectively. If the rotation shaft 4 is desired to be coupled with the inner sleeve 3, the protrudent threads 43 of the rotation shaft 4 and the threaded section 331 of the inner sleeve 3 are locked to one another such that the through hole 41 is extended above the inner sleeve 3 and the radial through hole 44 on the lower portion is received by the through hole 33. In this portion, the outer diameter of the inner sleeve 3 has a smaller dimension than that of the through hole 33 so as to form a gap between the inner sleeve 3 and the through hole 33. Moreover, in order to confine the rotation shaft 4 to the inner sleeve 3, an orientation ring 35 is jammed in the shallow trench 32. A circular orientation flange 321, which is mounted on the upper edge of the shallow trench 32, fixes the orientation ring 35, which is jammed in the shallow trench 32. The fixed orientation ring 35 imprisons the rotation shaft 4 to prevent it from being separated from the inner sleeve 3.

Moreover, when the rotation shaft 4 and the inner sleeve 3 are assembled to the locking shell 2, the outside of the locking shell 2 is covered by the outer cover 6 to fix and orientate these components therein.

Figure 5:
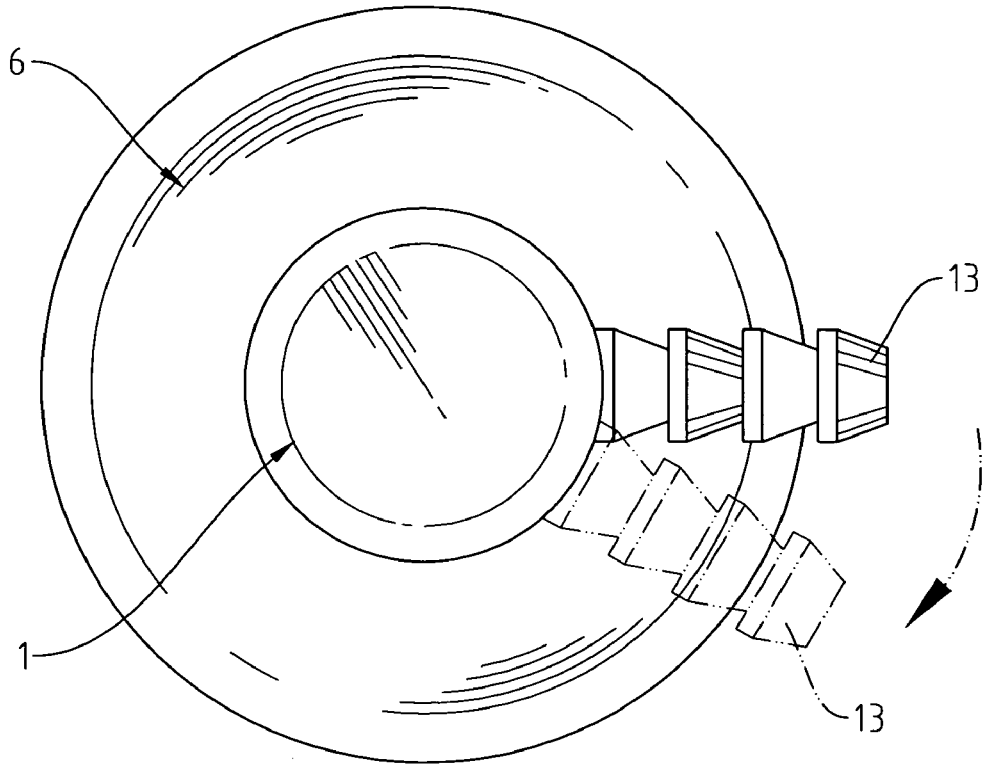
FIG. 5 is a schematic view, which shows that the spray head of the present invention is opened and closed by rotation.
Figure 6:
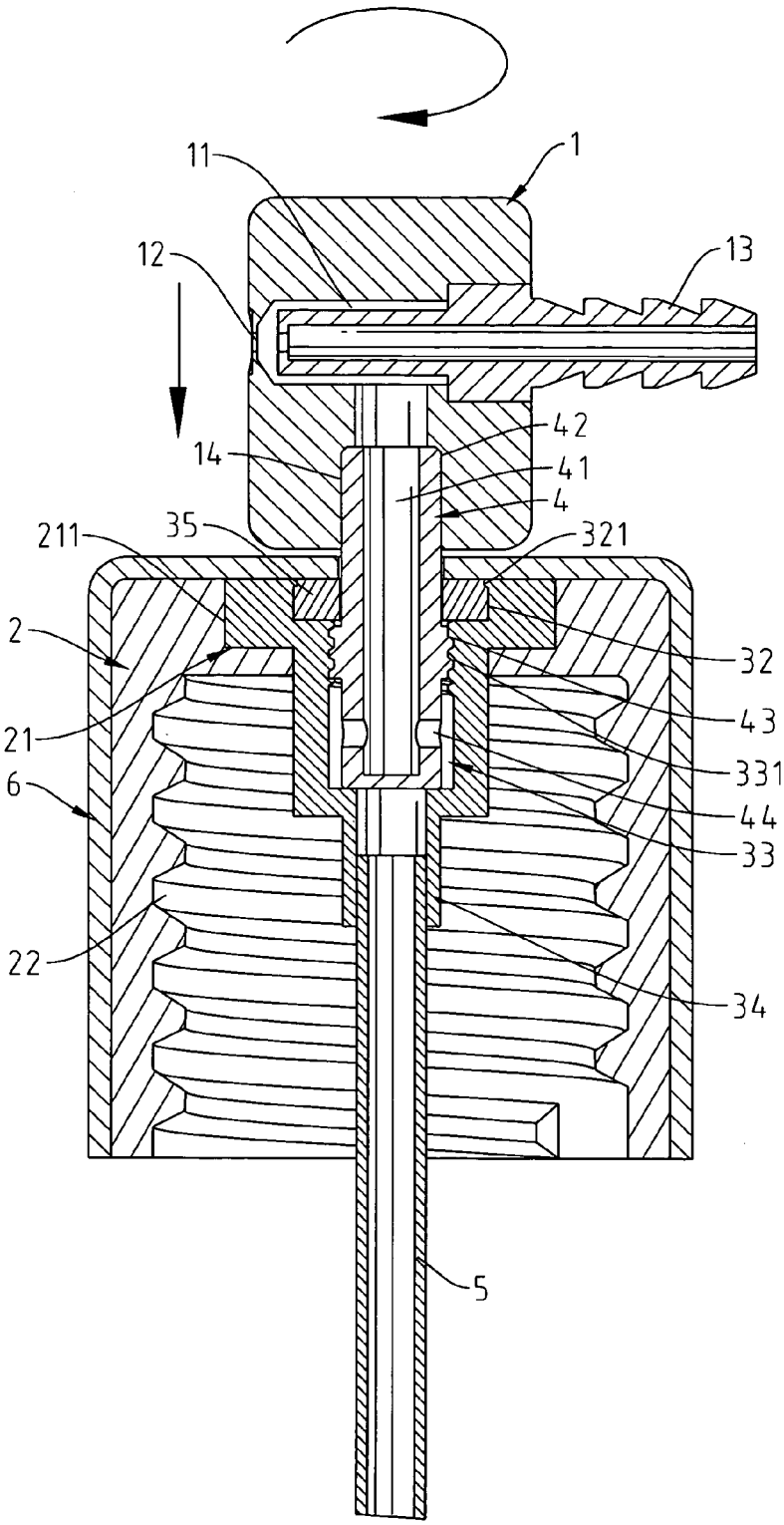
FIG. 6 is a cross-section view, which shows that the spray head of the present invention is locked by rotation.

The leakproof perfume spray head in accordance with the present invention is shown in FIG. 5 and FIG. 6. According to the aforementioned structure, the inner-toothed hole 14, which is formed inside the spray head 1, is engaged with the circular teeth 42 of the rotation shaft 4. Therefore, the spray head 1 drives the rotation shaft 4 to perform rotation when it is rotated. Because of the small rotation force caused by the small threading relationship between the circular teeth 42 and the threaded section 331, the rotation of the spray head 1 will not drive the locking shell 2 for rotation together. However, the locking shell 2 is tightly engaged with the perfume bottle by means of the large thread. The protrudent threads 43 of the rotation shaft 4 are locked to the threaded section 331 of the inner sleeve 3. The threaded section 331 enables the rotation shaft 4 to be rotated within the angle of about 30 degrees. Therefore, the rotation shaft 4 can be moved upward and downward by means of the rotation operation. If the spray head 1 is rotated in about 30 degrees, it also drives the connected rotation shaft 4 to perform rotation. In the meanwhile, the bottom end of the rotation shaft 4 presses the bottom end of the through hole 33 of the inner shell 3. In this manner, the outlet for the perfume liquid, i.e. the through hole 33, is closed so as to enclose the perfume liquid and prevent the perfume liquid from overflow and leakage.

Figure 7:
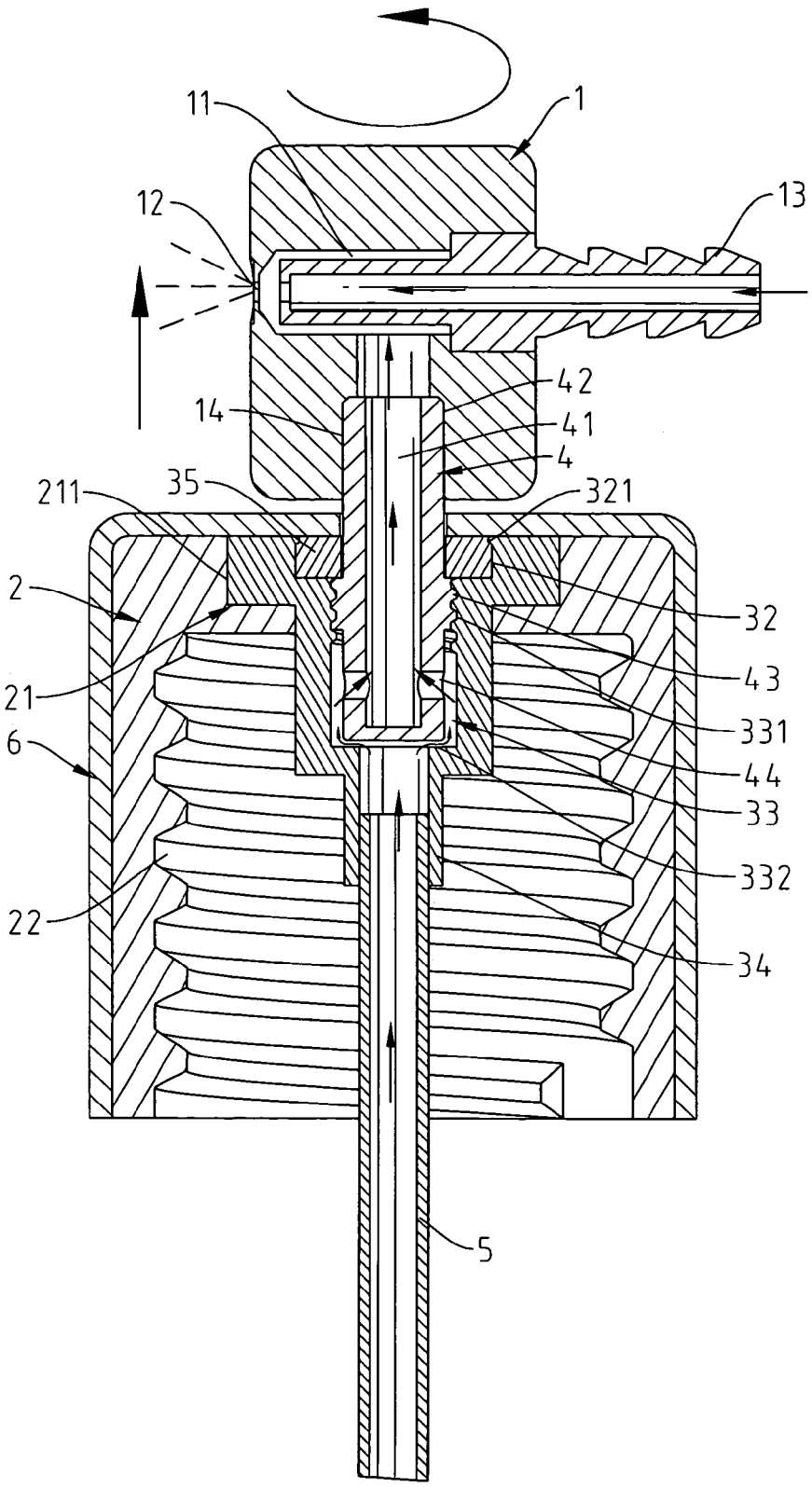
FIG. 7 is a cross-section view, which shows that the spray head is opened and the perfume liquid is sprayed out simultaneously.
Figure 8:
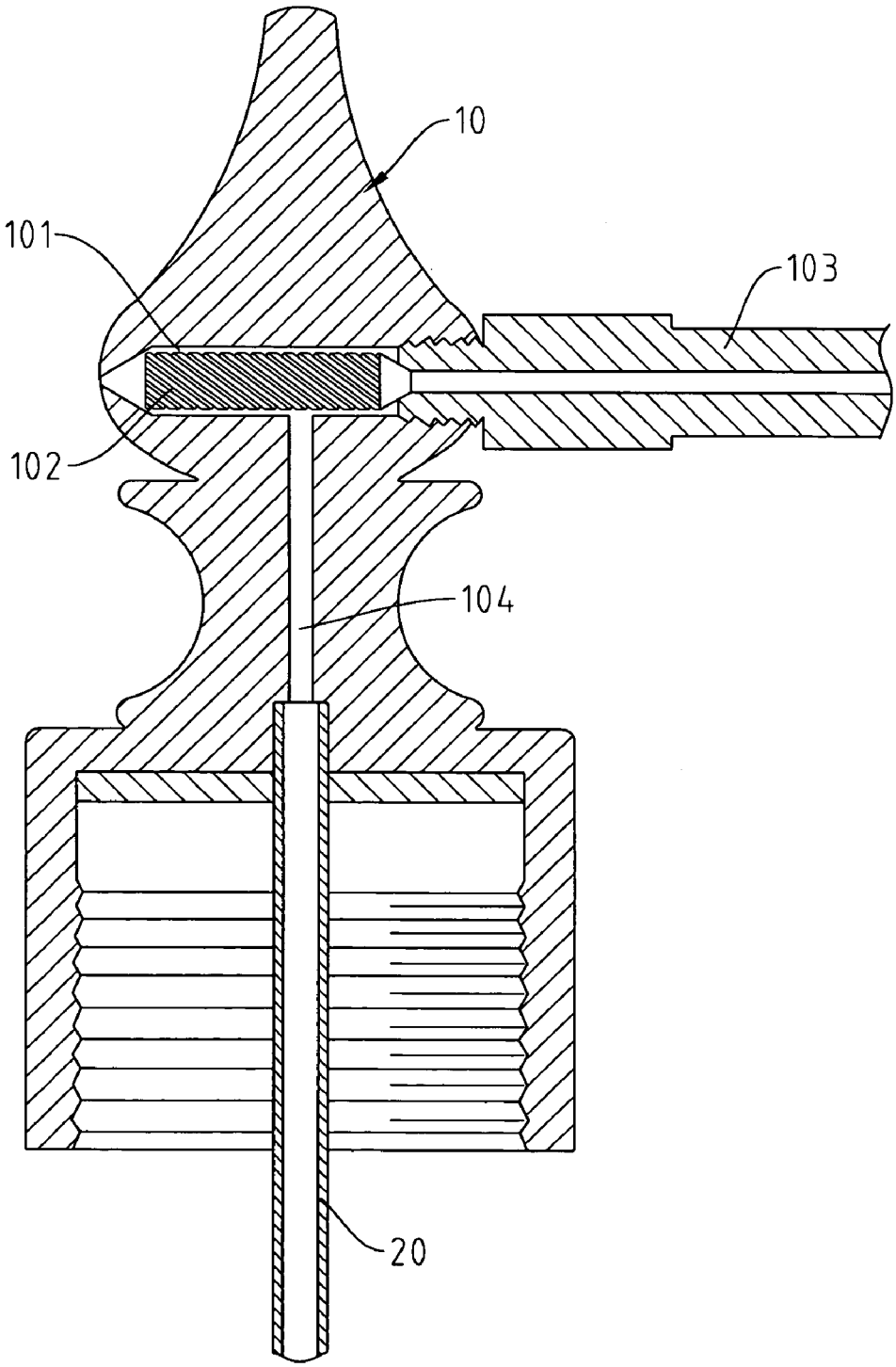
Fig. 8 Prior Art
FIG. 8 is a cross-section view showing the conventional perfume spray head.

Furthermore, the structure of the perfume spray head for spraying the perfume liquid in accordance with the present invention is shown in FIG. 5 and FIG. 7. In the aforementioned structure, the spray head 1 drives the rotation shaft 4 to perform rotation for preventing the perfume liquid from overflow and leakage. If it is desired to open the spray head 1, the spray head 1 is reversely rotated in about 30 degrees and the circular teeth 42 of the rotation shaft 4 are rotated along the threaded section 331 to move up the rotation shaft 4. In this manner, a tunnel 332 is formed between the bottom end of the rotation shaft 4 and the bottom of the through hole 33 of the inner sleeve 3. Accordingly, the perfume liquid is able to pass through the tunnel 332 and the rotation shaft 4 for being sprayed out from the spray head 1.

Since the leakproof perfume spray head of the present invention accomplishes the purposes of closing and opening the perfume bottle by means of small angle rotation. Therefore, if the perfume bottle is not in use or if it is in transportation, the spray head 1 can be rotated to drive the rotation shaft 4 to readily seal the inner tunnel. Consequentially, the transportation process and the high-temperature/high-pressure conditions will not result in the leakage and overflow problems of the perfume liquid. Furthermore, if it is desired to utilize the perfume bottle, the spray head is merely rotated in small angle to enable the rotation shaft to open the tunnel for spraying the perfume liquid.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. A leakproof perfume spray head comprising:

a spray head, a locking shell, an inner sleeve, a rotation shaft, and an outer cover, wherein said locking shell is locked to a perfume bottle such that the perfume liquid stored therein is able to pass through said rotation shaft for being sprayed out from said spray head that connects to said rotation shaft, wherein the improvement comprises:

a circular trench mounted above said locking shell, said circular trench having an indented connection trench on an inner surface thereof;

said inner sleeve comprising a circular connection body for engaging with said indented connection trench of said circular trench of said locking shell, a sleeving section mounted on a lower end of said inner sleeve and inserted into said locking shell, a shallow trench formed on the top of said inner sleeve, an orientation ring jammed in said shallow trench, a threaded section formed on an inner surface of a first through hole, wherein the center of said shallow trench communicated with said first through hole, and said first through hole and said sleeving section are connected with said rotation shaft and a waterline respectively;

said rotation shaft comprising a second through hole formed therein and protrudent circular teeth mounted on a medium portion and a lower portion of the outside of said rotation shaft such that said circular teeth separates protrudent threads and a radial through hole that mount on an upper portion and said lower portion of said rotation shaft respectively; and said outer cover mounted on the outside of said locking shell to fix and orientate said inner sleeve and said rotation shaft, which are assembled to said locking shell, wherein said protrudent threads are engaged with said threaded section by use of the connection between said rotation shaft and said inner sleeve such that said through hole is extended above said inner sleeve and said radial through hole is received by said first through hole, wherein said outer diameter of said inner sleeve has a smaller dimension than that of said first through hole for forming a gap between said inner sleeve and said first through hole, and said protrudent threads of said rotation shaft are locked to said threaded section of said inner sleeve such that said threaded section enables said rotation shaft to be rotated within an angle of about 30 degrees, wherein said rotation shaft can be moved upward and downward by means of rotation operation for achieving the purposes of opening or closing said leakproof perfume spray head.

2. The leakproof perfume spray head of claim 1, wherein a circular orientation flange is mounted on an upper edge of said shallow trench of said inner sleeve to confine and fix said orientation ring.

* * * * *